US006510596B1

(12) United States Patent
McCarthy

(10) Patent No.: US 6,510,596 B1
(45) Date of Patent: Jan. 28, 2003

(54) CREMATORY EGG INTERMENT SYSTEM

(76) Inventor: Margaret A. McCarthy, 605 N. Taft Hill Rd., Fort Collins, CO (US) 80521

( * ) Notice: Subject to any disclaimer, the term of this patent is extended or adjusted under 35 U.S.C. 154(b) by 35 days.

(21) Appl. No.: 09/645,739

(22) Filed: Aug. 24, 2000

Related U.S. Application Data

(60) Provisional application No. 60/150,426, filed on Aug. 24, 1999.

(51) Int. Cl.[7] ..... A61G 17/00

(52) U.S. Cl. ..... 27/1; 428/542.4

(58) Field of Search ..... 27/1; 428/542.4; 99/568, 495; D99/5

(56) References Cited

U.S. PATENT DOCUMENTS 2,800,409 A * 7/1957 Webb et al. ..... 426/90
5,016,330 A * 5/1991 Botsch ..... 27/1
5,289,762 A * 3/1994 Phillips ..... 99/495
5,297,477 A * 3/1994 Phillips ..... 99/495
5,317,962 A * 6/1994 Phillips ..... 99/495
6,200,507 B1 * 3/2001 Dennis ..... 264/73
6,260,480 B1 * 7/2001 Bardeen ..... 99/495

OTHER PUBLICATIONS

McCarthy, M., "The Eggcellent Collection: Cherished Series" Brochure, 1999, 1 page.
McCarthy, M., "The Eggcellent Collection" Brochure, 1999, 1 page.
"Decorated Eggs for Sale", www.creativeside.com, McCarthy, Mar. 1999.*

* cited by examiner

*Primary Examiner*—William L. Miller
(74) *Attorney, Agent, or Firm*—Santangelo Law Offices, P.C.

(57) ABSTRACT

A crematory egg interment system that provides devices and methods for interring cremated remains of humans or animals in an esthetically acceptable manner for display, burial, or preservation. The crematory egg interment system further includes business methods for interment or cremated remains using a crematory egg interment vessels.

8 Claims, 13 Drawing Sheets

CREMATORY EGG INTERMENT SYSTEM

This application claims the benefit of U.S. Provisional Application No. 60/150,426, filed Aug. 24, 1999, hereby incorporated by reference.

BACKGROUND OF THE INVENTION

A crematory egg interment system for preserving at least a portion of the cremated remains of an animal. Generally, a business establishment for interring the remains of deceased animals. Specifically, a crematory egg interment vessel and methods of preparing crematory egg interment vessels.

A desire to maintain and memorialize cremated remains of the deceased in a dignified manner has been a longstanding tradition in many societies over the centuries. Cremation of animal remains, including human remains, coupled with the use of a crematory egg interment vessel provides the consumer with a practical alternative for the preservation and display of cremated remains while addressing many of the problems of conventional interment some of which are described below.

A significant problem for the consumer may be the cost of interment. The extremely high cost of a crematory vault, a burial site, burial vault, or casket provided by the conventional funeral or interment industry may be cost prohibitive, if not impossible in today's society.

Another significant problem for the consumer may be space availability, including dealing with the numerous restrictions set out as zoning or other governmental regulations which deal with the proper disposition of deceased animals. For example, there are statutory codes for disposition of dead animals in Colorado such as §25-1-612 CRS (1990), hereby incorporated by reference. In addition, there may be city municipal codes, for example those of the City of Fort Collins found under Chapter 4, §4-76, Animal and Insect Code, hereby incorporated by reference.

Yet another problem facing the consumer may be the ever-growing mobile society in which the necessity of relocation for reasons such as employment opportunity is often present. Having to leave a deceased loved one behind can be a negative emotional experience fraught with feelings of guilt.

An additional challenge facing today's society may be the separation of family units in geographically. Family members often have the desire to have the remains of a loved one kept close. This can present problems in cases where family members may reside in different cities, states, or even countries and can be made impossible by limiting interment options to burial, for example.

Another problem for the consumer may be the inability to remember the physical features of a deceased loved one over time.

The consumer may also be faced with limited choices with respect to crematory vessels that may be viewed or displayed in a decorative manner rather than in a merely utilitarian manner for the cremated remains of a deceased loved one.

Still another problem may be the environmental impact of burying traditional caskets or cremation vessels.

The present invention discloses a crematory egg interment system which addresses each of the above-mentioned problems associated with the existing methods and apparatus used for interment of cremated remains of animals including humans.

SUMMARY OF THE INVENTION

This invention provides an alternative method of preserving cremated remains by the use of a natural, esthetically pleasing egg shell vessel. Accordingly, the present invention accomplishes the following objectives.

A significant objective can be to provide a business establishment to cremate animal remains and to inter the cremated remains of deceased animals, including the cremated remains of human beings.

Another significant objective can be to provide a crematory egg interment vessel in which cremated remains can be maintained.

Another significant objective can be to provide a vessel for cremated remains of deceased animals that addresses the problems associated with zoning regulations or laws which relate to the proper disposition of deceased loved ones.

Another objective of the present invention can be to provide a cost-effective manner in which the cremated remains of the deceased may be maintained in a decorative or utilitarian manner as the consumer finds appropriate.

An additional objective can be to provide the consumer a means by which the cremated remains of a deceased loved one can be easily relocated along with an individual or family as the need for relocation arises.

Still another objective can be to provide the consumer with a means in which the cremated remains may be divided and distributed among other family members or individuals as may be desired.

Yet another objective can be to provide a utilitarian storage crematory egg interment vessel for cremated remains.

Another objective of the present invention can be to provide a manner in which the cremated remains may be maintained or preserved in a unique, decorative, dignified manner.

Another objective of the present invention can be to provide images of the deceased prior to cremation.

The present invention can also provide an environmentally friendly interment vessel that may be buried with minimal environmental impact.

Naturally further objects of the invention are disclosed throughout the specification and claims.

DETAILED DESCRIPTION OF PREFERRED EMBODIMENTS

Figure 1:
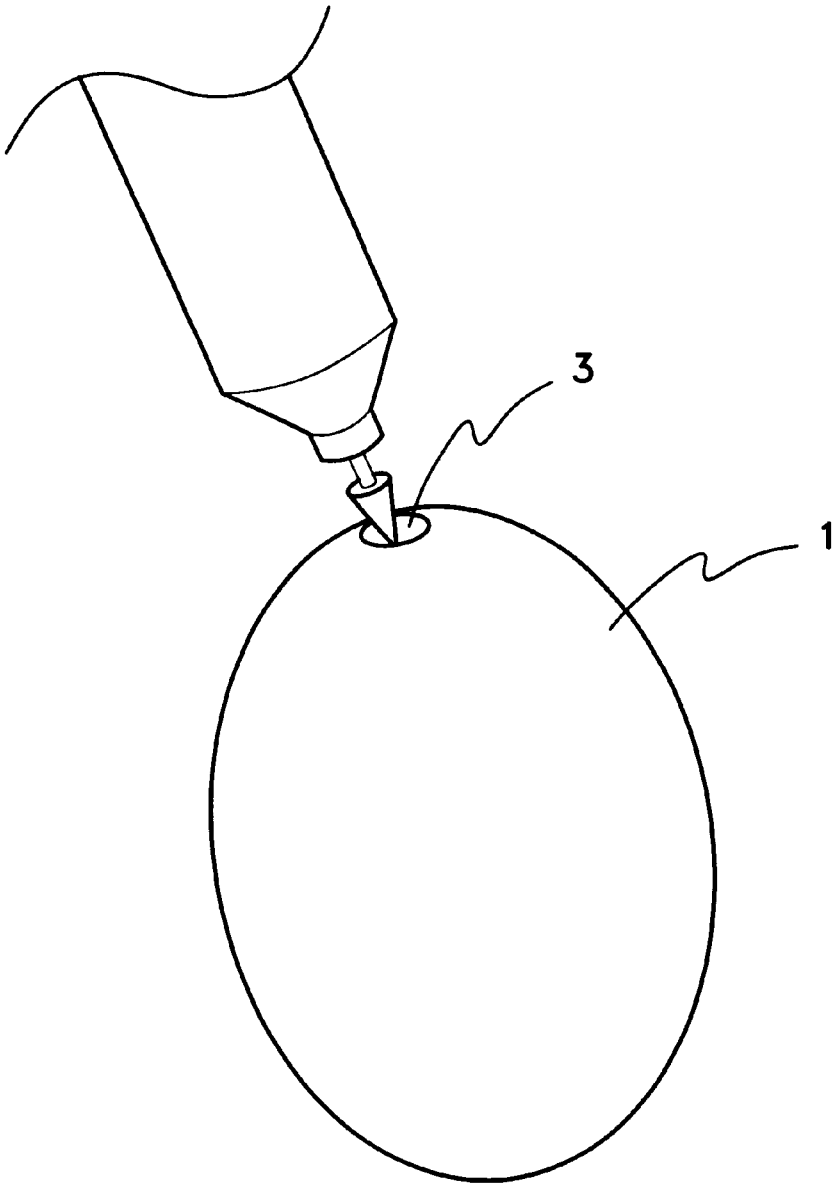
FIG. 1 shows an opening being drilled in the end of an egg.

As can be easily understood, the invention includes a variety of aspects including business methods, and apparatus and methods which may be combined in different ways to create the crematory egg interment system. Many embodiments of the invention are shown in FIGS. 1 to 13. The figures illustrate crematory egg interment vessel preparation techniques, techniques for increasing durability of the crematory egg interment vessel, procedures and devices to accomplish the insertion of cremated remains of deceased animals into the crematory egg interment vessel, including the cremated remains of human beings, and for final sealing or reinforcing the crematory egg interment vessel. Each of these aspects of the crematory egg interment system is described separately.

A broad embodiment of the invention comprises an eggshell (1), and a portion of cremated remains of an animal (2) within the eggshell (1). With respect to the eggshell, any and all eggshells may be utilized in the manufacture of a crematory egg interment vessel with the exception of eggshells that are obtained from what is known as "native and/or wild bird populations" as described through local governing ordinances. For example, ostrich eggshells, emu eggshells, rhea eggshells, goose eggshells, duck eggshells, chicken eggshells, pheasant eggshells, parrot eggshells, turkey eggshells, dove eggshells, or quail eggshells can be used, as well as, many others.

The basic invention is not restricted with respect to the type of cremated remains (2) which can be transferred to the crematory egg interment vessel. For example, a portion or all of the cremated remains of human beings, equids, bovids, canids, felids, rodents, birds, fish, or reptiles can be interred within an egg interment vessel. Naturally, the cremated remains (2) of other animals could also be interred in this manner.

FIGS. 1–9 show the initial preparation of the whole egg. It is suggested that protective eye wear and a respiratory protection device be utilized during the cleaning and preparation of crematory egg urn vessels.

First, a whole egg can be washed in a mild solution of detergent such as common, household dish washing liquid detergent and water to rid the outer shell (1) of debris and dirt. Ideally, the egg should be allowed to reach room temperature so that extreme temperature variations do no occur between the water temperature and the egg temperature. A large degree of temperature fluctuation between the egg temperature and the water temperature can cause cracking of the eggshell at this point. Additionally, care should also be taken not to use high temperatures of water that would cause the inner egg to harden or actually cook, making it virtually impossible to remove the contents of the egg in the method to be described.

The eggshell (1) can then be rinsed well with water. In the event of stains on the shell (1), a destaining solution can be prepared such as approximately one part 5.25% sodium hypochlorite mixed with approximately three parts water. The proportion of sodium hypochlorite or other destain compound can be adjusted to some degree so as to be effective with certain types of stains. The shell (1) may be soaked for a period of approximately 5 to 10 minutes. The eggshell (1) may remain in this solution longer until stains are removed. The eggshell, however, should be checked frequently at this point to insure that the sodium hypochlorite solution or other destain compound does not dissolve the shell to the point that the shell is weakened. When the eggshell (1) has been sufficiently bleached, it should be rinsed again with tepid water to insure the removal of the sodium hypochlorite solution from the shell (1). The shell (1) should be dried using toweling or allowed to air dry at this point.

Figure 2:
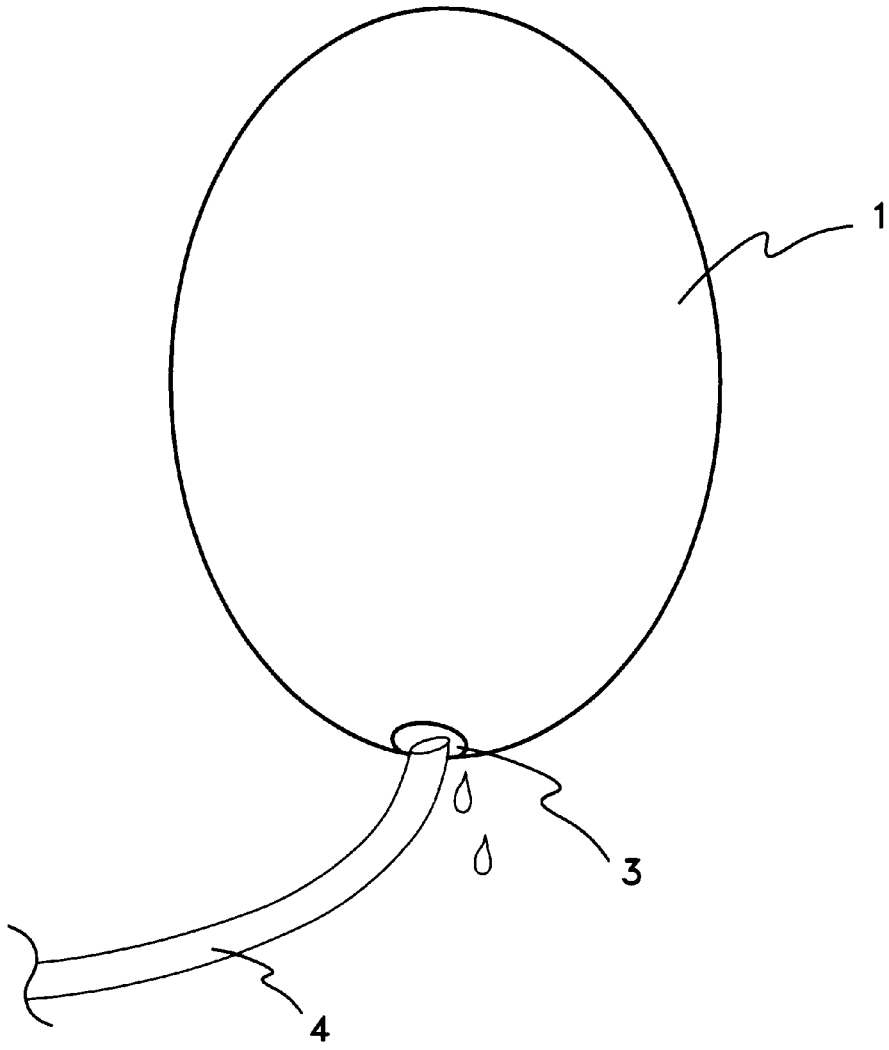
FIG. 2 shows compressed air being forced into the drilled end of the egg forcing egg contents out.

As shown by FIG. 1 and FIG. 2, an embodiment of the invention uses a hole (3) of approximately ¼ inch size drilled into the end of the eggshell (1) for egg contents removal. A standard drill with a ¼ inch flame drill bit can be used. Either end of the egg or center area may be chosen for hole placement. The eggshell (1) is inverted so that the hole (3) is facing downward. Compressed air is forced into the egg. A small air pump with about ¼ inch plastic tubing (4) attached can be utilized in applying air pressure to the inside of the egg sufficient to expel the egg contents without causing damage to the eggshell. In the event that small droplets of albumen are noted on the outside of the shell, the air pressure source should be immediately removed. The droplets of albumen being expelled through the pores of the eggshell exterior are an indicator that excessive pressure is being applied and the shell may possibly crack at this point. Different methods of producing air pressure within the egg may be used up to and including a small syringe or aquarium air pump. An alternative method can be utilized to expel the contents of the egg by the use of a small hole drilled into each end of the shell (1). Air pressure may be applied to the hole at one end of the egg thereby expelling the contents through the hole located at the other end of the shell.

Figure 3:
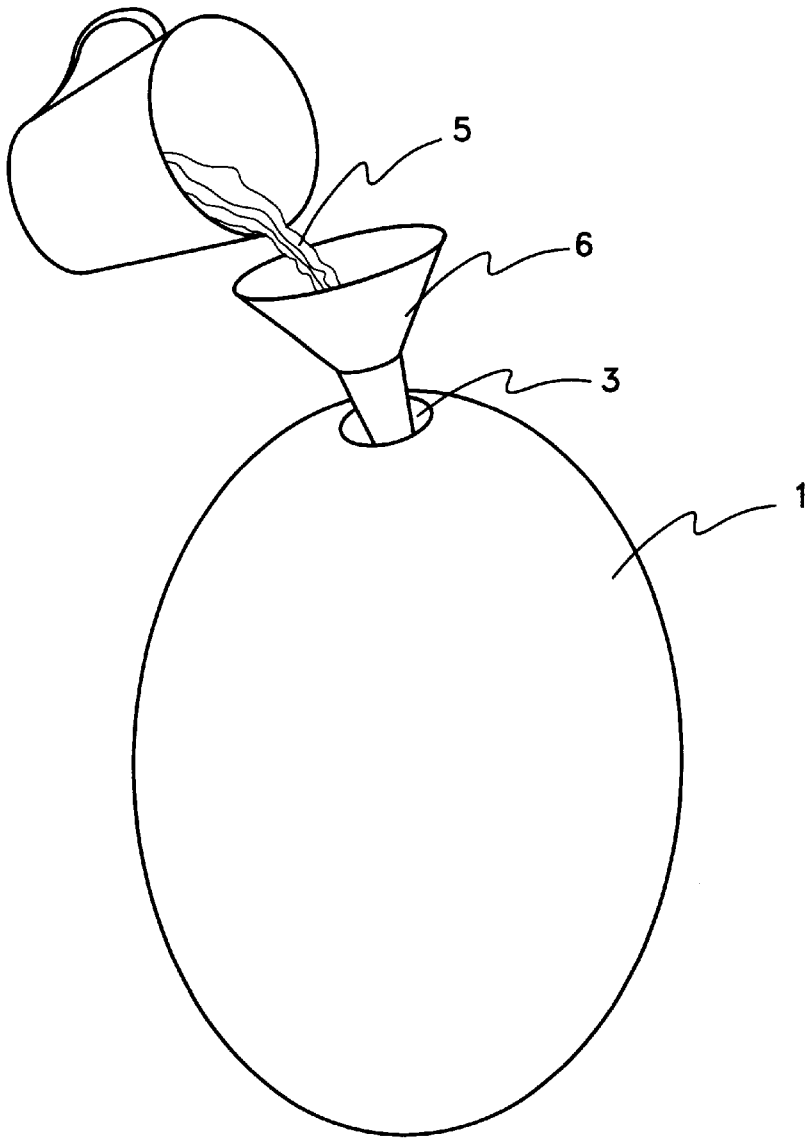
FIG. 3 shows a sanitizing solution being placed into the egg shell.

As shown in FIG. 3, another embodiment of the invention uses a sanitizing solution (5) of about 5.25% sodium hypochlorite mixed with tepid tap water at a rate of approximately 1 part sodium hypochlorite to 3 parts water to sanitize the eggshell (1). This sanitizing solution is injected into the hole (3) in the eggshell sufficiently to fill approximately ¾ of the inside of the eggshell. The introduction of this sanitizing solution may be made by the use of a small syringe or by pouring the solution into a funnel (6) that has been placed into the hole in the eggshell (1). Placing your finger over the hole in the shell (1), shake the shell to insure rinsing of the inside with the solution. Once again, light air pressure should be placed into the inverted eggshell. To expel the sanitizing solution air pressure may again be applied to the inside of the eggshell. Water for the purpose of rinsing the inside of the eggshell may be pored, injected or funneled into the eggshell. Once again, the hole (3) in the eggshell (1) is covered and the eggshell (1) is shaken to insure rinsing of the inside of the eggshell (1). Again, compressed air can be placed into the eggshell through the hole thereby expelling the water rinse solution. The process of sanitizing and rinsing may be repeated as necessary according to the degree of sanitizing and rinsing judged to necessary for maximum sanitation. Naturally, other types of sanitizing solutions (5) could be used including salt, antibiotics, or the like to kill bacteria. The interior surface and the exterior surface of the eggshell have now been sanitized. The shell (1) can then be placed in a stand or propped up with the hole (3) side down in order for the excess rinse solution to drain out and the interior of the eggshell to dry.

Figure 4:
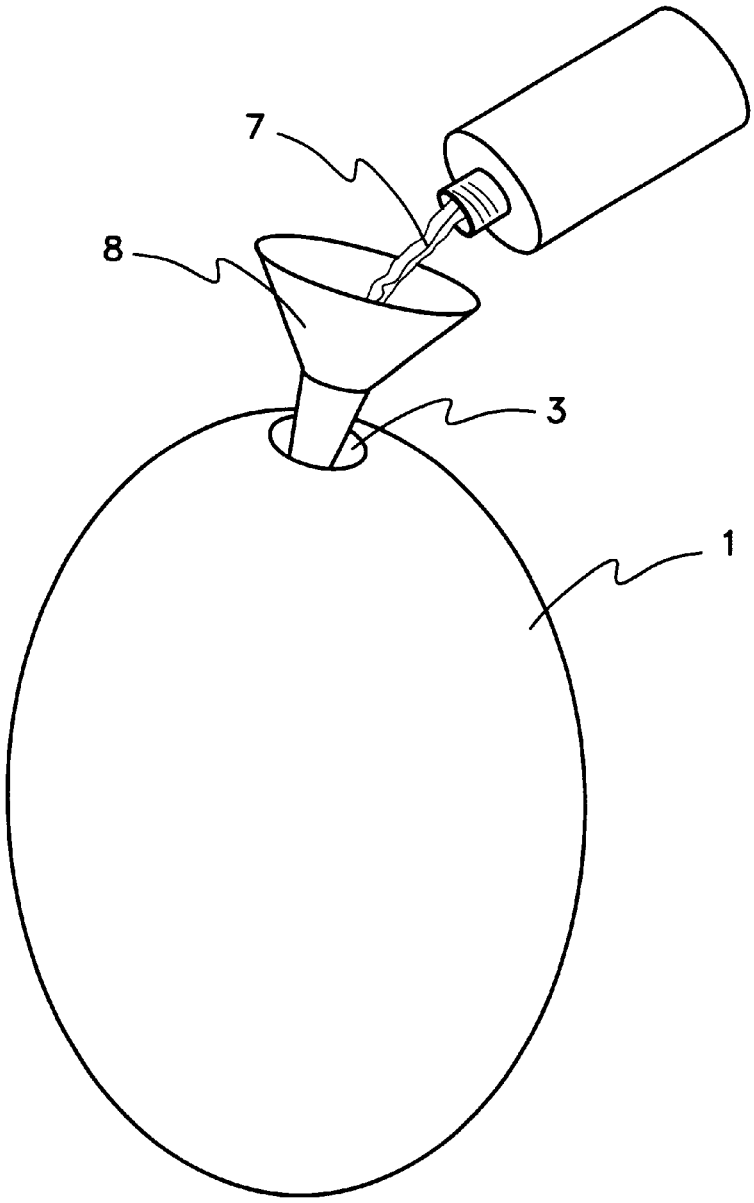
FIG. 4 shows a reinforcing solution being placed inside of the egg shell.
Figure 5:
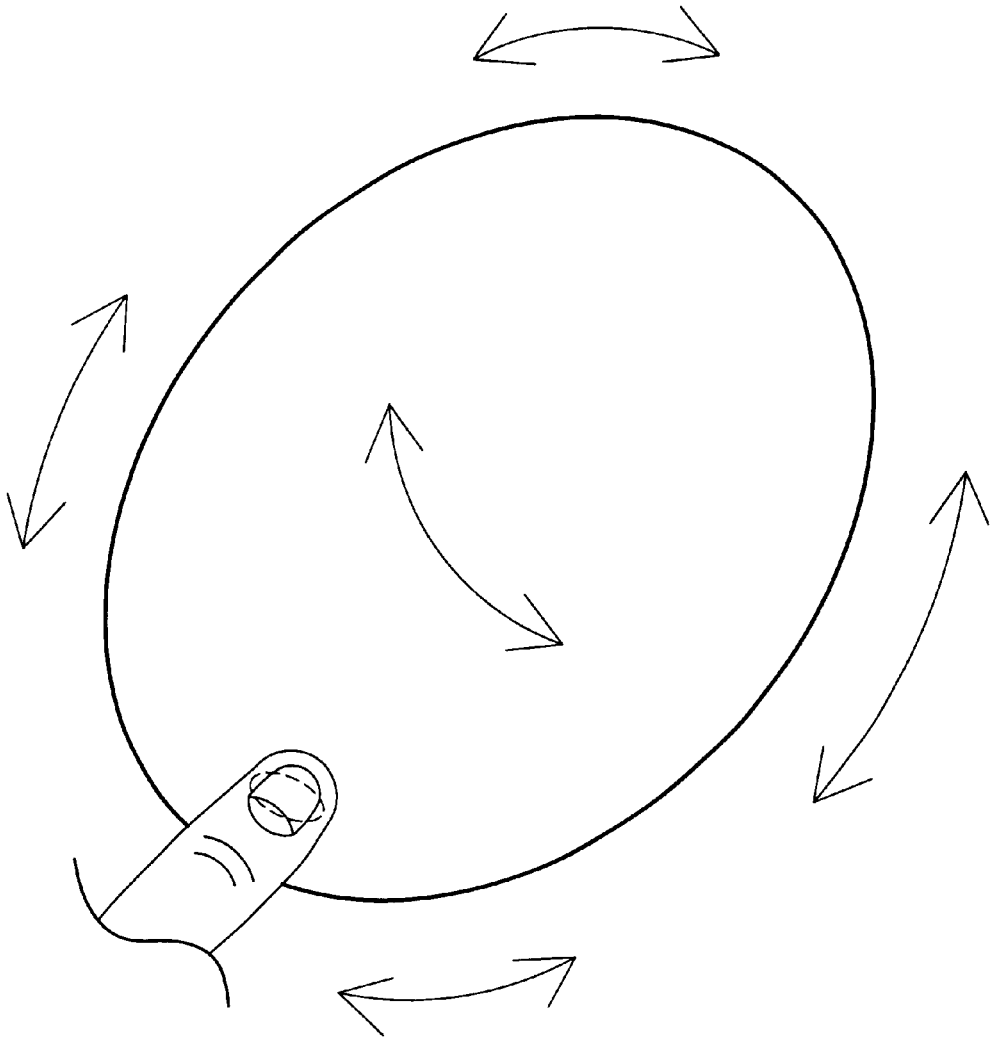
FIG. 5 shows the egg shell being rotated in a manner to allow reinforcing solution to coat the interior surface.

Another embodiment of the crematory egg interment vessel further comprises a first reinforcement element responsive to the interior surface of the eggshell. FIG. 4 shows one type of reinforcing element, a reinforcing solution (7), being poured into the eggshell. As one example of a reinforcing material, a water-based, polyurethane varnish may be used such as may be available from Delta Ceramcote Gloss Exterior/Interior Polyurethane Varnish made by Delta Technical Coatings, Inc., Whittier, Calif. 90601. In addition, numerous other types of water-soluble or petroleum based varnish products may be used in order to gain the desired affect of strengthening the eggshell such as a toluene, xylene product manufactured by Plaid Enterprises, Inc., Norcross, Ga. 30091-7600. A small funnel (8) or syringe may be used to facilitate the process. Other types of reinforcement elements can include plastic films or plastic polymers applied to the interior surface. The hole (3) in the end of the eggshell (1) should be plugged using your finger and the shell should be rotated in order to coat the interior of the shell with the reinforcing solution as illustrated in FIG. 5. The eggshell can be placed with the hole side down allowing excess reinforcing solution to drain out or continuously rotated to spread a amount of reinforcing solution evenly over the interior surface as it dries. The eggshell should be allowed to dry for approximately 12 to 24 hours or as directed on manufacturer's label. The steps shown in FIGS. 4 and 5, or as described above, may be repeated as deemed necessary in order to acquire the level of reinforcement needed according to the original shell thickness. More numerous applications of this step may be required on a shell of less density such as a duck eggshell than would be necessary for an eggshell with the denseness of an Ostrich eggshell.

Figure 6:
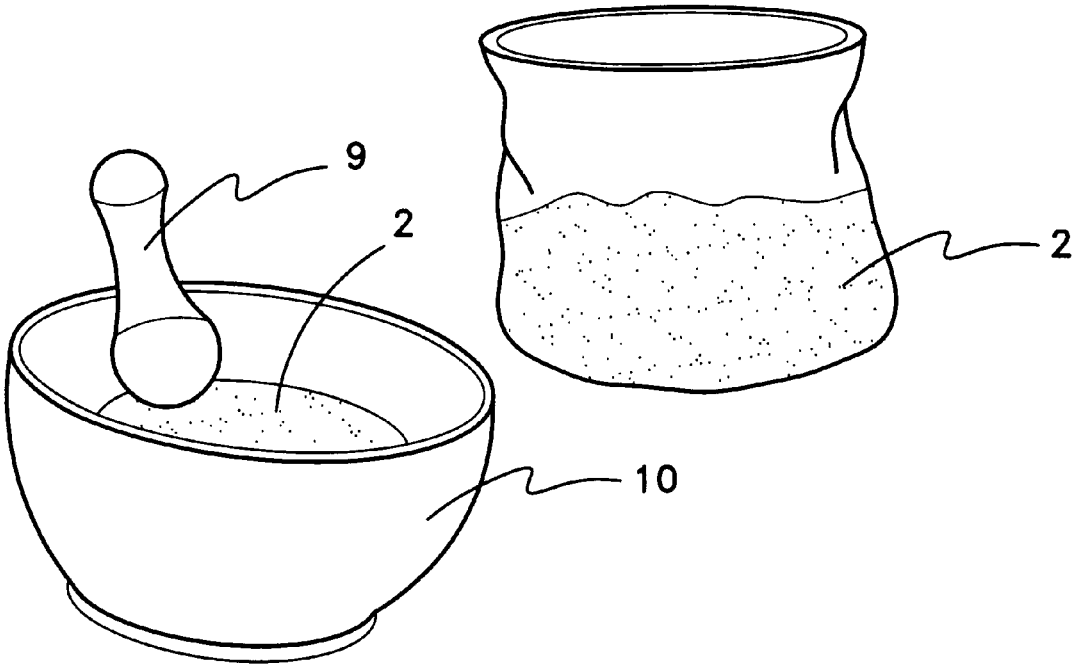
FIG. 6 shows cremated remains being prepared using a grinding mechanism.

As shown in FIG. 6, an embodiment of the invention comprises preparing the cremated remains (2) by crushing the cremated remains (2) through the use of a mortar (10) and pestle (9) sufficient to facilitate their being placed into the approximate ¼ inch hole (3) in the eggshell (1). Of course, any method of reducing the particle size of the cremated remains (2) to the desired size could be used. Other effects of the deceased animal could also be cremated with the animal, or could also be reduced to the desired particulate size.

Figure 7:
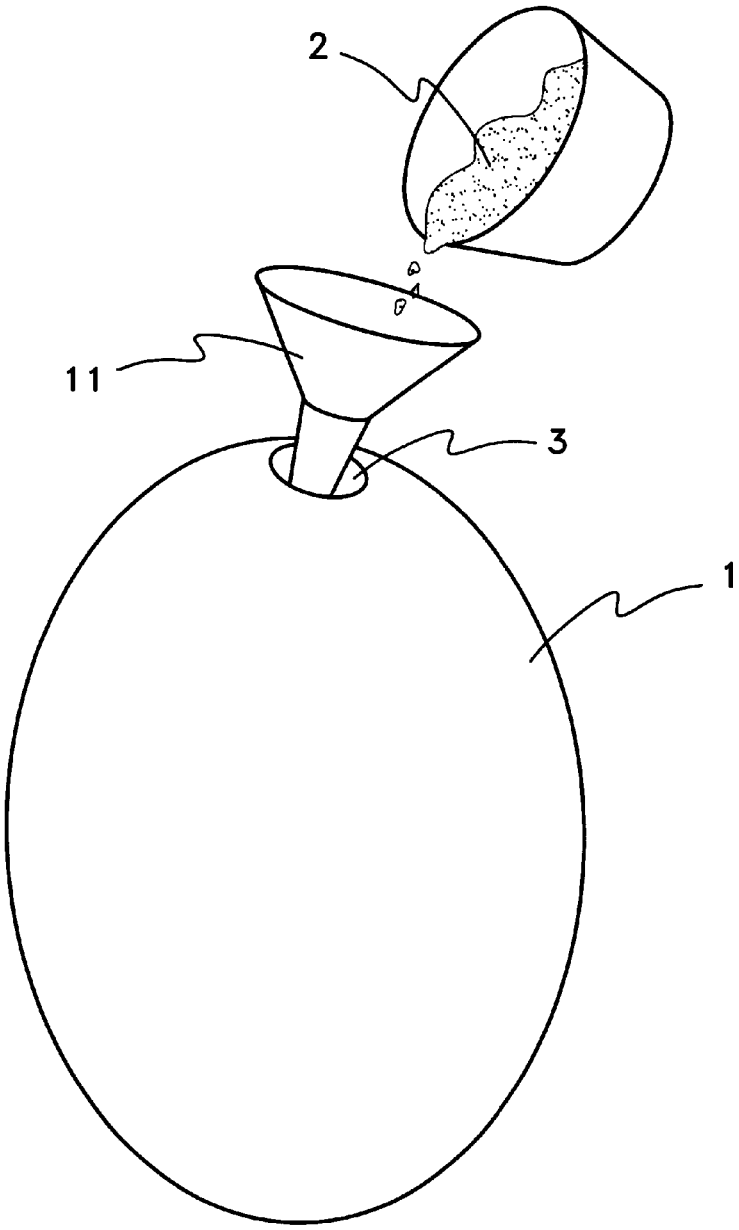
FIG. 7 shows cremated remains being transferred into the egg shell.

The cremated remains (2) now reduced to the desired particle size can be transferred within the eggshell. FIG. 7 shows one method of transferring a portion of the cremated remains (2) of a deceased animal within the eggshell (1) by using a funnel. Naturally, other transfer devices or methods could be effective so long as they transfer the cremated remains into the eggshell.

Figure 8:
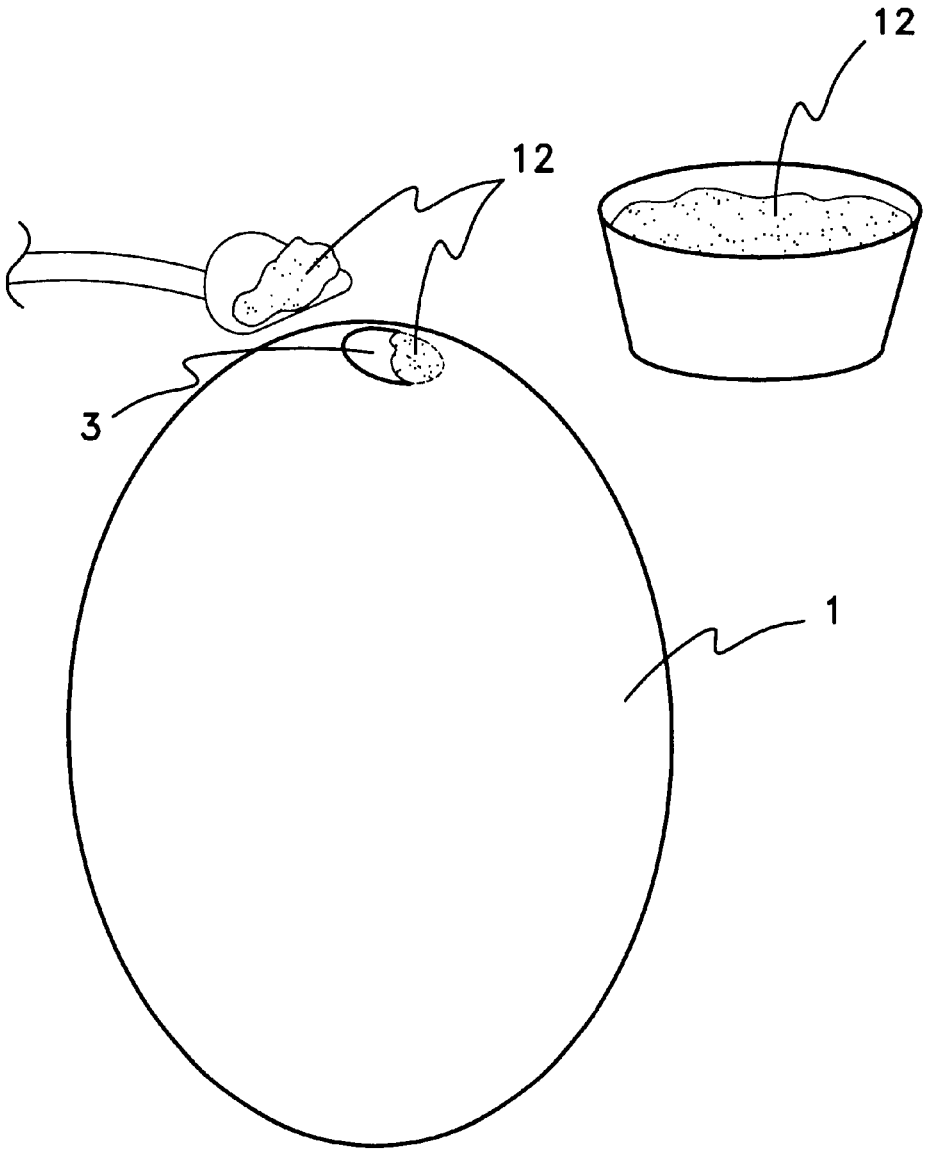
FIG. 8 shows a opening-filling compound being placed in the opening of the egg shell.
Figure 9:
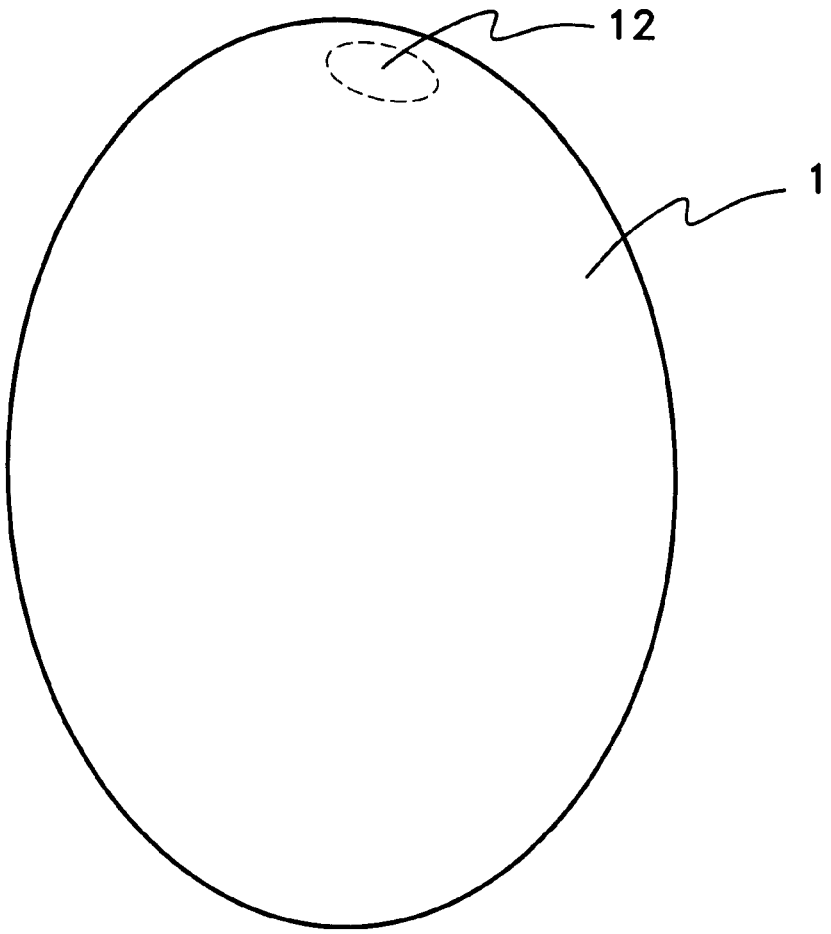
FIG. 9 shows the opening-filling compound being sanded down to a desired level relative to the egg shell.

As shown by FIG. 8, one embodiment of the invention further comprises a seal element (12) to fill openings (3) which communicate between the interior surface and the exterior surface of the eggshell (1). A opening-filling or hole-filling compound such as a mixture of calcium carbonate and water, as but one example, can be used to seal the hole in the end of the eggshell or other openings. Many different products such as wall spackling, wax or wood filler products may be used. The calcium carbonate and water paste mixture may be the preferred method. A suitable product is "That White Stuff" presently distributed by Lane's, 1951 Olive Drive, Santa Maria, Calif. 93454. Other seal elements that can be used are preformed rubber, wax, or plastic plugs sized to the opening in the eggshell. After the seal element has been position or has been allowed to dry sufficiently the seal element area can be sanded smooth with extra fine grit abrasive paper so as to be flush with the exterior surface of the eggshell, as shown in FIG. 9. The sealed area (12) can then be painted to approximately match the original eggshell coloring using acrylic or oil based paint. Once again, the area is allowed to dry completely.

Figure 10:
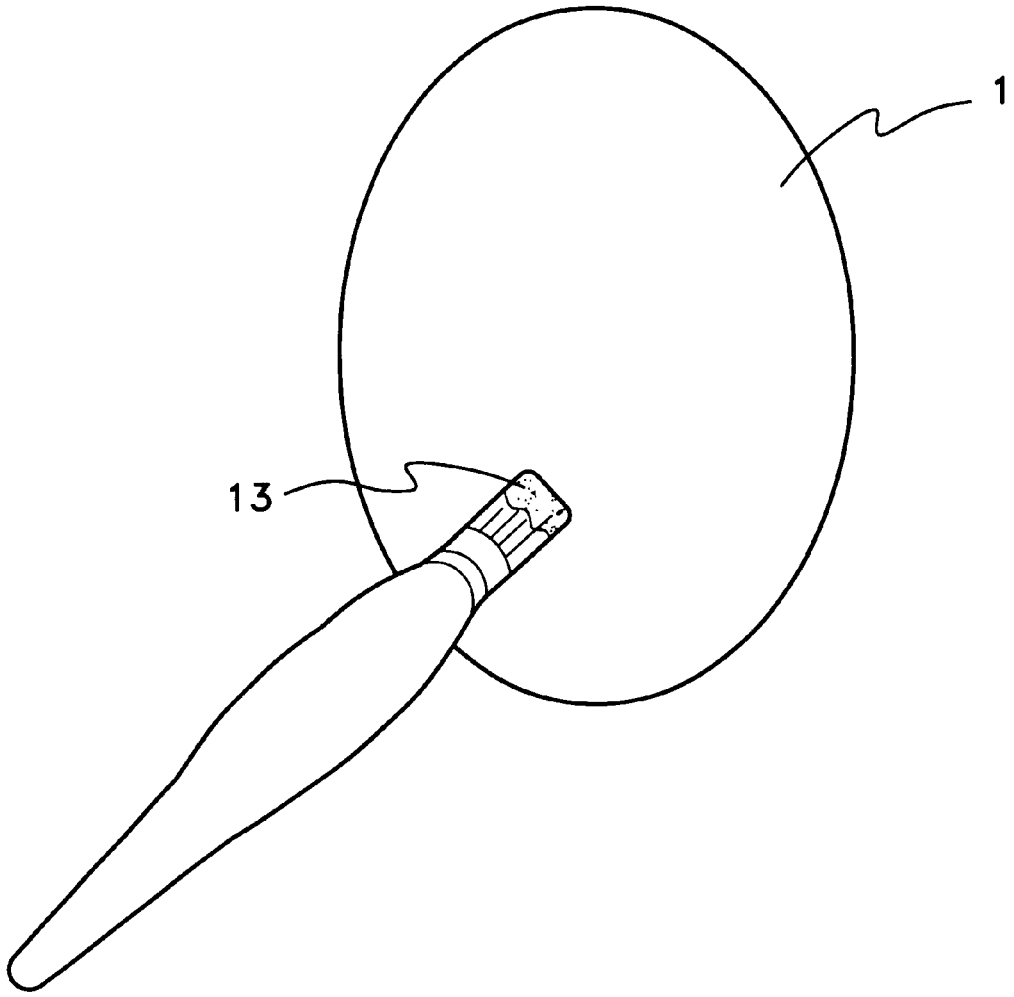
FIG. 10 shows the crematory egg urn vessel being painted to a desired background color.
Figure 11:
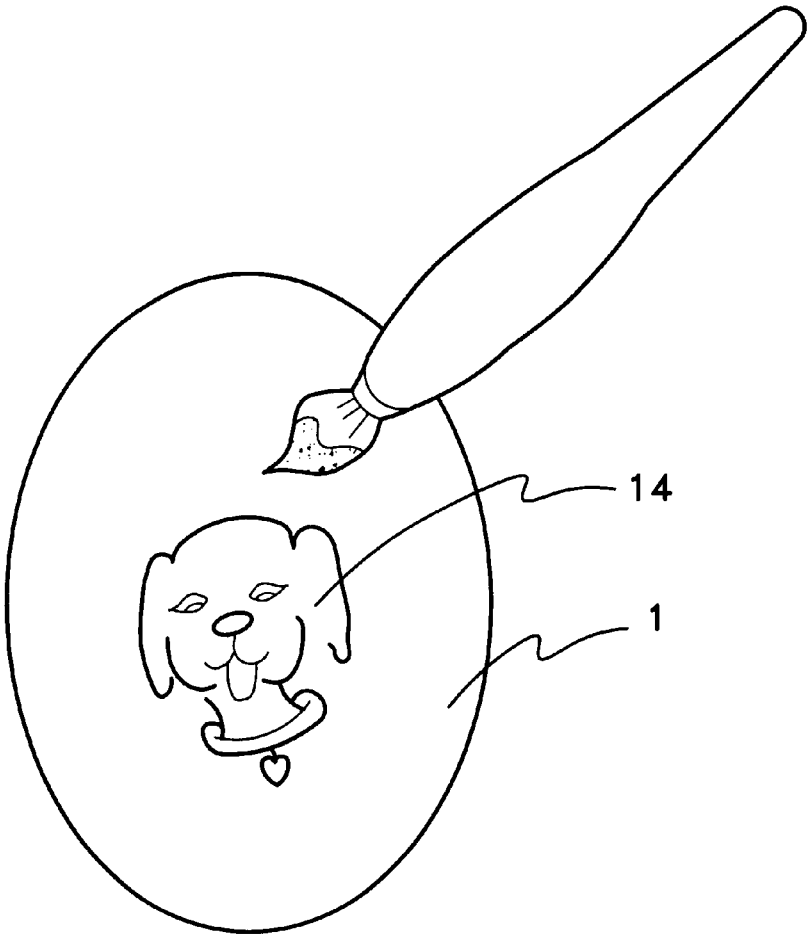
FIG. 11 shows a particular embodiment of the egg shell being painted with a portrait, for example a portrait of a dog.
Figure 12:
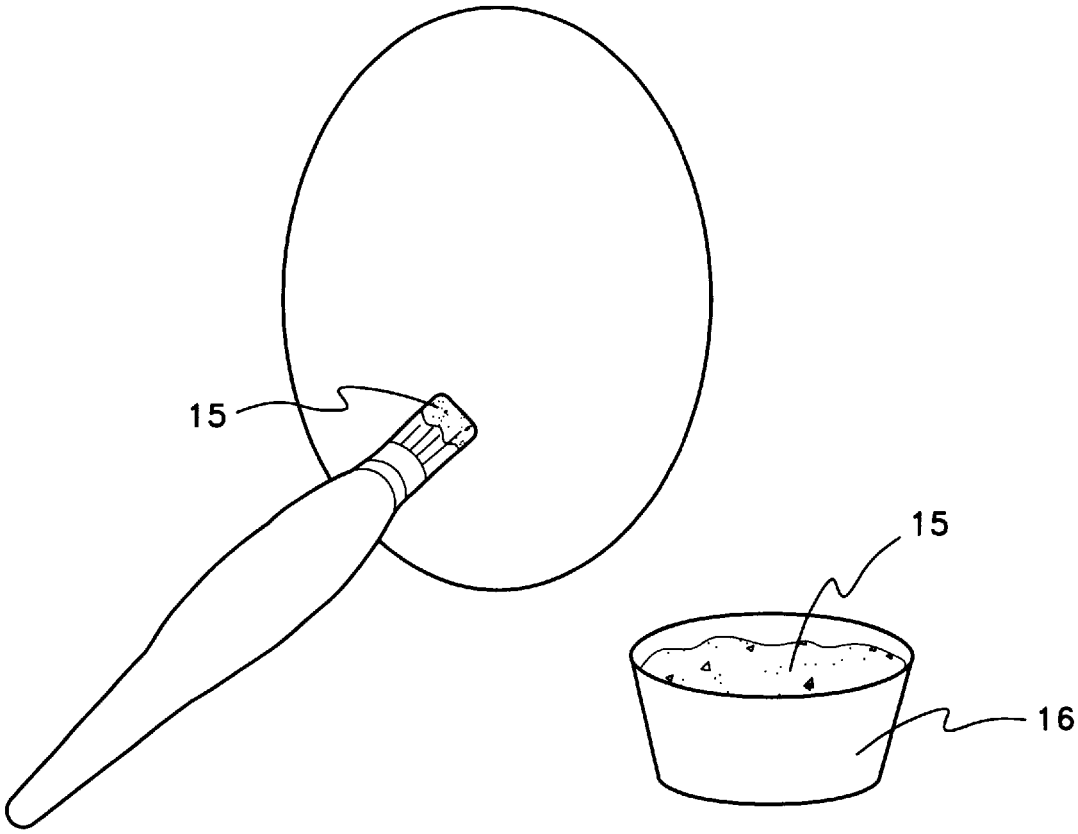
FIG. 12 shows a reinforcing solution being applied to the exterior surface of the egg shell.

Once the cremated remains (2) of the deceased animal have been sealed within the eggshell (1), the additional aspect of decorating the shell that may be done as desired or requested. In the event that decoration such as a painted or a carved portrait of the deceased or other painted or carved decoration is to be applied, it may be done at this point before the final sealer or exterior reinforcement element is applied to the outer shell. It has been noted that paint achieves better adhesion at this stage. It has also been noted that the carving aspect is better achieved at this point due to the fact that some of the sealers and hardeners can cause damage to the cutting and drilling equipment used in the carving of eggshells. For example, as shown by FIG. 10, a base color paint (13) may be applied to the eggshell (1) after it has been sealed (12). Also as shown by FIG. 11, an image (14) may be applied to the exterior of the eggshell. The image may be a representation of the deceased prior to the time of cremation. The images (14) may be painted on the exterior surface over a base color of paint (13) or may be decals or shrink wrap images which are sized to the exterior surface by heating the shrink wrap material. Other images (14) or decorative patterns could be applied as indicated above or as desired. As shown in FIG. 12, an embodiment of the invention may further comprise a second reinforcement element (5) responsive to the exterior surface of the eggshell (1). A water-based polyurethane varnish may be applied to the entire exterior surface of the eggshell. This polyurethane varnish can be the same product as used in the sealing of the inside of the eggshell. The sealant may be applied with a standard paint brush or painting sponge in one or a plurality of coats. Or the eggshell containing the cremated remains may be rotated over a container of liquid reinforcement material (16) until the reinforcement element achieves the desired thickness. The number of applications or thickness of the reinforcement element is determined to give the eggshell (1) increased structural integrity as determined by the original density of the shell that is being used.

Figure 13:
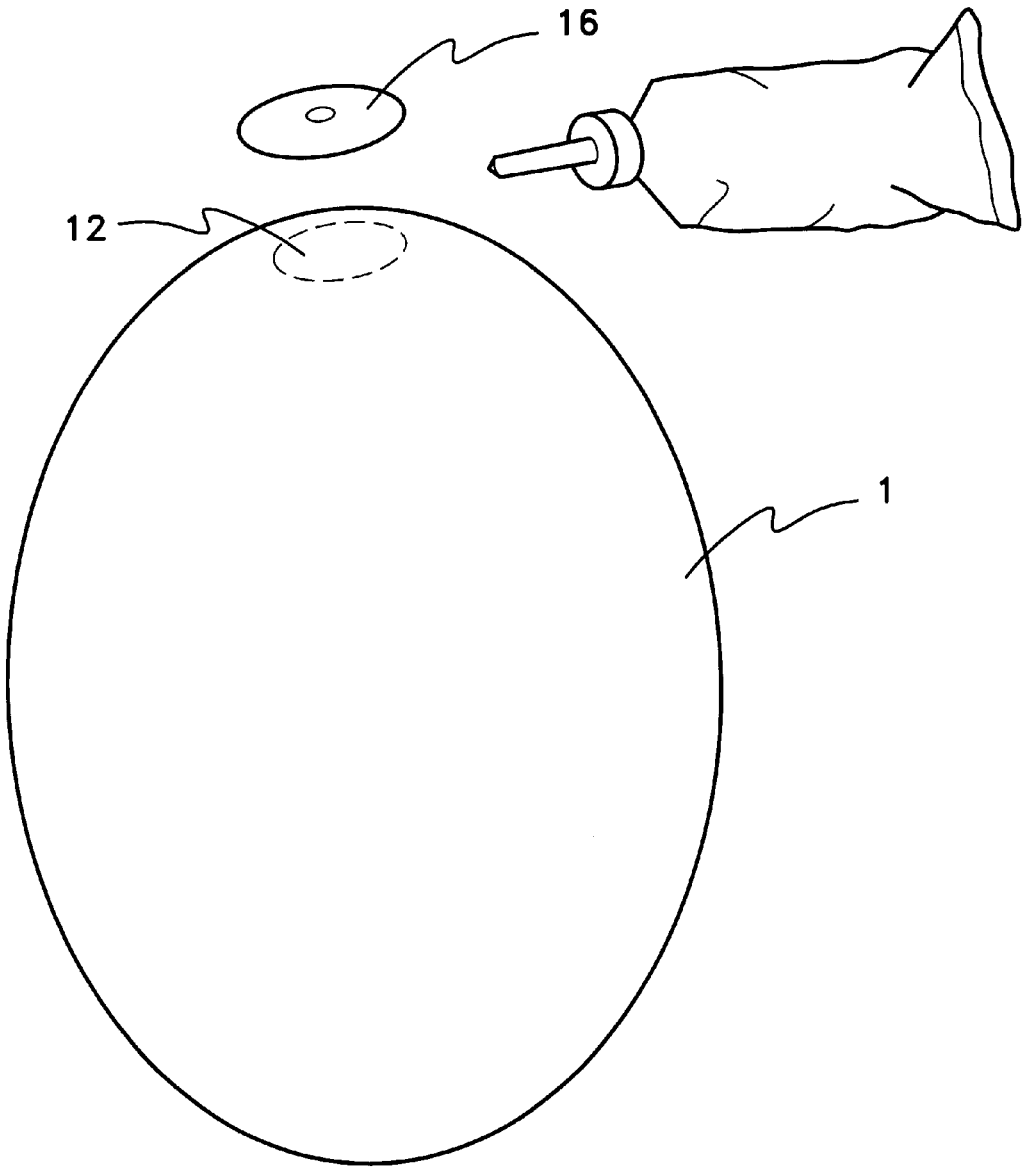
FIG. 13 shows a cap being adhered over the previously open area that has been sealed with the opening-filling compound.

As shown in FIG. 13, a particular embodiment of the invention may have a decorative cap (16) adhered to the eggshell (1) over the previously open area (12) that has been sealed with the eggshell hole-filling compound. An adhesive which may be used is an acetone adhesive made by Bond Adhesives Company, Newark, N.J. 07114. This decorative cap (16) may or may not be used but is used to provide additional stability to the compromised area of the shell.

Alternate embodiments of the crematory egg urn vessel include crematory egg interment vessels which are cut in half either longitudinally or latitudinally. The halves of the shell are prepared as described above. A hinge mechanism may be used to couple the two halves together.

Importantly, crematory egg interment vessels may be used for the interring or preserving all or any portions of cremated remains of any human or any animal within an eggshell. If desired, portions of the cremated remains of the deceased animal may be allocated into a plurality of eggshells so that family members may each have a portion of the cremated remains of the deceased animal. The crematory egg interment vessels may be used as decorative art pieces in home settings. Alternately, another embodiment of the invention comprises a necklace or bracelet which may be worn. A plurality of matching crematory egg interment vessels may be provided to family members each containing a portion of the deceased animal's cremated remains.

Yet another embodiment of the invention omits the use of the additional reinforcement material applied to the inside or to the outer eggshell so that the crematory egg urn vessel may be environmentally degraded.

The crematory egg interment vessel may be used in a decorated state for burial or display. Cremated remains may also be separated with partial remains encapsulated inside a crematory egg interment vessel with the remainder of ashes to be scattered, as the consumer deems appropriate.

Crematory egg urn vessels may be used as preferred by the consumer in both utilitarian or the decorative manner. Crematory egg urn vessels may or may not have an image of deceased or have other images carved into the shell in a decorative fashion, as the consumer prefers it. An additional option may be that the surface of the shell be left in its natural state with or without the use of a exterior surface reinforcement element.

Additional embodiments of the invention involves cutting or altering of the eggshell and the use of hinges, hinged rings, screw rings or other connecting devices in order to produce a crematory egg interment vessel that incorporates the use of a lid. In the event that this method is used, the cremated remains may be kept in a plastic bag and placed into the crematory egg urn vessel for possible retrieval at a later time. This embodiment of the invention also may be painted, decorated in any fashion where the original outside appearance of the eggshell is altered in any manner. The interior of this eggshell may be left in its original state or decorated or altered from its original appearance.

A business establishment or business method for interring deceased animals could be developed around the basic idea of interring the cremated remains of a deceased animal by placing the cremated remains into at least one eggshell to provide a crematory egg interment vessel as described above. A part of the business method could focus on applying an image of the deceased to the exterior surface of the crematory egg interment vessel. Another basic part of the business could comprise a crematory for cremating the deceased animal. Such a business method could be located in a conventional brick and mortar setting or within electronic commerce or both. All aspects of interring the remains of deceased animals could provided by this type of business establishment. This business method could also be incorporated into existing mortuary or interment business establishments or used with conventional business methods to allow the consumer additional services.

It is thought that the apparatuses and methods of the embodiments of the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all action may be expressed as a means for taking that action or as an element which causes that action. Similarly, each physical element disclosed should be understood to encompass a disclosure of the action which that physical element facilitates. Regarding this last aspect, and as but one example the disclosure of "cremated remains" should be understood to encompass disclosure of the act of "cremating remains"—whether explicitly discussed or not—and, conversely, were there only disclosure of the act of "cremating remains", such a disclosure should be understood to encompass disclosure of an "cremated remains". Such changes and alternative terms are to be understood to be explicitly included in the description.

Any acts of law, statutes, regulations, or rules mentioned in this application for patent; or patents, publications, or other references mentioned in this application for patent are hereby incorporated by reference. In addition, as to each term used it should be understood that unless its utilization in this application is inconsistent with such interpretation, common dictionary definitions should be understood as incorporated for each term and all definitions, alternative terms, and synonyms such as contained in the Random House Webster's Unabridged Dictionary, second edition are hereby incorporated by reference. Finally, all references listed in any information disclosure filed with and/or for the application are hereby incorporated by reference, however, as to each of the above, to the extent that such information or statements incorporated by reference might be considered inconsistent with the patenting of this/these invention(s) such statements are expressly not to be considered as made by the applicant(s).

Further, the disclosure should be understood to include support for each feature, component, and step shown as separate and independent inventions as well as the various combinations and permutations of each.

In addition, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible in countries such as Australia and the like.

Thus, the applicant(s) should be understood to claim at least: i) each of the embodiments of crematory egg interment system as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, and ix) methods and apparatuses substantially as described hereinbefore and with reference to any of the accompanying examples, and x) the various combinations and permutations of each of the elements disclosed.

I claim:

1. A method of interring cremated remains of a deceased animal, comprising the steps of:

a. providing an avian eggshell;

b. cremating said deceased animal;

c. transferring a portion of said cremated remains of said deceased animal into said avian eggshell.

2. A method of interring cremated remains of a deceased animal as described in claim 1, further comprising the steps of:

a sanitizing an interior surface of said avian eggshell; and b. sanitizing an exterior surface of said avian eggshell.

3. A method of interring cremated remains of a deceased animal as described in claim 2, further comprising the step of sealing openings in said avian eggshell which communicate between said interior surface of said eggshell and said exterior surface of said eggshell.

4. A method of interring cremated remains of a deceased animal as described in claim 3, further comprising the step of reinforcing said interior surface of said avian eggshell.

5. A method of interring cremated remains of a deceased animal as described in claim 4, further comprising the step of reinforcing said exterior surface of said avian eggshell.

6. A method of interring cremated remains of a deceased animal as described in claim 5, further comprising the step of applying an image to said exterior surface of said avian eggshell, wherein said image represents said deceased animal prior to cremation.

7. A method of interring cremated remains of a deceased animal as described in claim 6, further comprising the step of preserving said cremated remains of said deceased animal within said avian eggshell.

8. A method of interring cremated remains of a deceased animal as described in claim 1, further comprising the step of allocating said cremated remains of said deceased animal into a plurality of avian eggshells.

* * * * *